United States Patent [19]

Schmidt

[11] Patent Number: 4,750,459

[45] Date of Patent: Jun. 14, 1988

[54] DYNAMIC PRESSURE LIMITATION WITH SAFETY VALVE

[76] Inventor: Alfred Schmidt, Burgstrasse 11, Pottenstein, Fed. Rep. of Germany, 8573

[21] Appl. No.: 886,002

[22] Filed: Jul. 16, 1986

[30] Foreign Application Priority Data

Sep. 19, 1985 [DE] Fed. Rep. of Germany ..... 3533393

[51] Int. Cl.[4] ..... F02D 9/06

[52] U.S. Cl. ..... 123/323; 188/273

[58] Field of Search ..... 123/323; 188/154, 273

[56] References Cited

U.S. PATENT DOCUMENTS

| | | | |
|---|---|---|---|
| 2,895,571 | 7/1959 | Hanebeck | 123/323 |
| 4,111,166 | 9/1978 | Alstrin et al. | 123/323 |
| 4,682,674 | 7/1987 | Schmidt | 188/273 |

FOREIGN PATENT DOCUMENTS

| | | | |
|---|---|---|---|
| 1080813 | 4/1960 | Fed. Rep. of Germany | 188/154 |
| 1555833 | 6/1973 | Fed. Rep. of Germany | 188/273 |
| 3211920 | 10/1983 | Fed. Rep. of Germany | 123/323 |
| 2063998 | 6/1981 | United Kingdom | 123/323 |

*Primary Examiner*—Tony M. Argenbright
*Assistant Examiner*—Eric R. Carlberg
*Attorney, Agent, or Firm*—Holman & Stern

[57] ABSTRACT

A dynamic pressure-limiting device in an engine exhaust brake, wherein the edge surface of a butterfly disc valve in its closed position is bypassed at one point by a poppet valve bore in which is slidably arranged a poppet valve head which is resiliently urged into the closed position by a spring to provide a safety valve which responds with greater reliability when the upper dynamic pressure limit is exceeded, the response being matched to the amount the limit is exceeded, includes a narrow gap between the butterfly valve disc in its closed position and the poppet valve head in its closed position, and the characteristic of the spring rises at a ratio of spring force (N) to spring deflection (mm) of 1.5–2.5:1. Allowance is made in determining the spring characteristic for the suction effect of the flowing gas on the poppet valve head.

10 Claims, 3 Drawing Sheets

SPRING CHARACTERISTIC
SPRING FORCE (N)
DEFLECTION (mm)
10
8
6
4
2
1
2
3
4
5

I
I
1
2
3
4
5
6
7
10
11
13
18
19

DYNAMIC PRESSURE LIMITATION WITH SAFETY VALVE

BACKGROUND OF THE INVENTION

1. Field of the Invention

This invention relates to a device to limit the dynamic pressure in an engine exhaust brake wherein a butterfly valve is movably supported in an exhaust pipe to be deflected from an open position into a closed position.

2. Description of the Prior Art

In a prior-art device of this type German Utility Pat. No. 84 24 212, which corresponds to co-pending U.S. patent application Ser. No. 763,216, filed Aug. 7, 1985, now U.S. Pat. No. 4,682,674, the butterfly valve in its closed position also contacts the end face of the poppet valve head and the spring has a characteristic about whose rate of rise nothing is stated. During tests using this device, the safety valve failed to respond either when the upper dynamic pressure limit was exceeded by a small amount or when the upper dynamic pressure limit was considerably exceeded.

BRIEF SUMMARY OF THE INVENTION

It is an object of the present invention, therefore, to provide a device of the type initially referred to whose safety valve will respond with greater reliability on the upper dynamic pressure limit being exceeded, the response being matched to the amount by which said limit is exceeded. In solving this problem, the invention provides a device wherein a poppet valve bore bypassing the disc of the butterfly valve when situated in the closed position is provided in the exhaust pipe, a poppet valve head which is slidable in the poppet valve bore is forced by means of a spring into its closing position, the cross-section of the exhaust pipe is round, the butterfly valve disc is elliptical and is in a slightly oblique position when closed, the poppet valve bore axis being offset from the pivot axis of the butterfly valve disc, the edge face of the butterfly disc being situated only in its closed position at the poppet valve bore or poppet valve head respectively and the end face of the poppet valve head being matched to the curvature of the inside surface of the exhaust pipe. The invention is also characterized in that a narrow gap exists in between the butterfly valve disc situated in its closed position and the poppet valve head situated in its closed position and in that the characteristic of the spring rises at a ratio of spring force (N): spring deflection (mm) from 1.5–2.5:1.

The narrow gap extending across the poppet valve head prevents the poppet valve head from being sucked down by the flowing gas and hindered from opening any further under conditions where the poppet valve head is slightly open. The rise of the spring characteristic is selected so that the poppet valve head will, with due consideration of the suction effect, recede in proportion to the amount by which the dynamic pressure exceeds the desired limit.

As a rule, engine exhaust brakes operate with a dynamic pressure of 4–7 bar. Matched to this pressure, the narrow gap is approximately 0.25–0.5 mm wide. The ratio of spring force to spring deflection is as a rule of the order of approximately 2:1.

BRIEF DESCRIPTION OF THE DRAWINGS

A preferred embodiment of the invention will now be described with reference to the drawing wherein.

DETAILED DESCRIPTION

Figure 1:
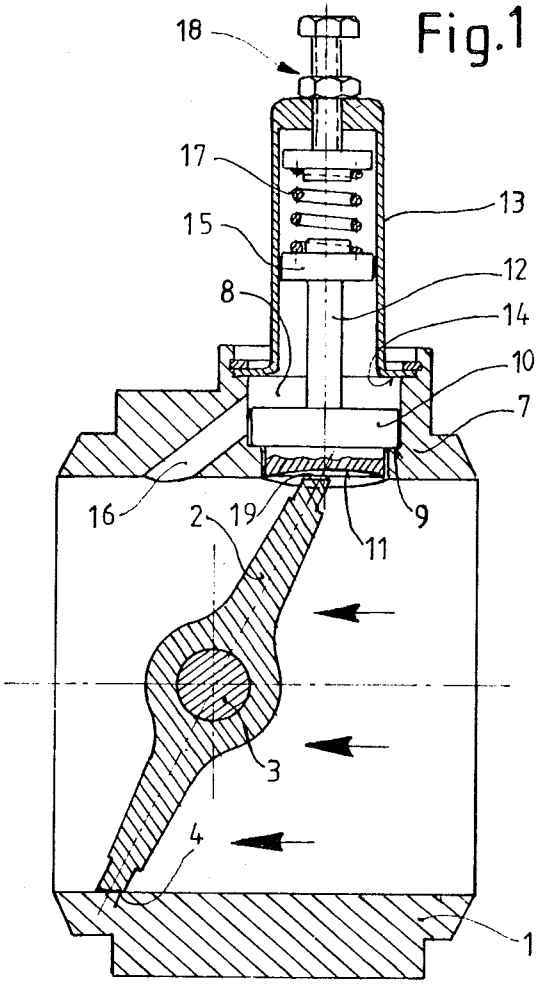
FIG. 1 is a cross-sectional view taken along line I—I of FIG. 3 through the device of the invention for limiting the dynamic pressure in an engine exhaust brake with the poppet valve head in the closed position.
Figure 2:
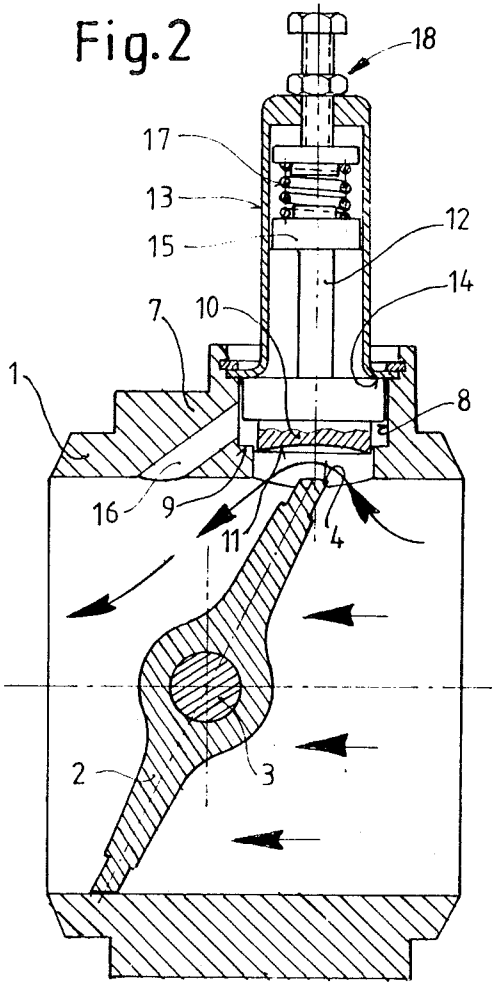
FIG. 2 is a view similar to FIG. 1 with the poppet valve head opening.
Figure 4:
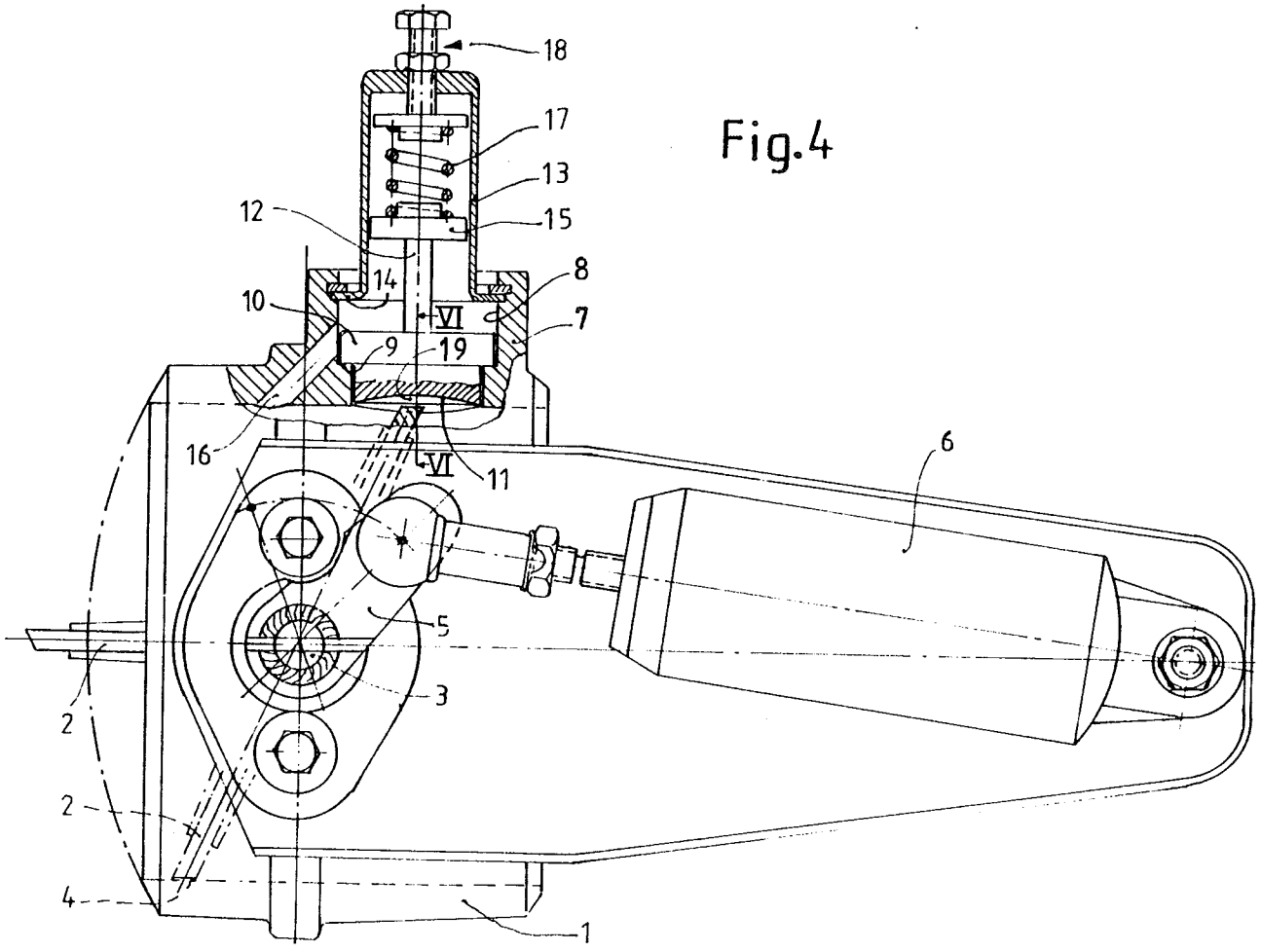
FIG. 4 a right side elevational and partially cross-sectional view of FIG. 3.

In the drawing, the numeral 1 denotes a piece of an exhaust pipe which is circular in cross-section and in which the disc 2 of a butterfly valve is arranged pivotably an a shaft 3 having its axis located to coincide with the inside diameter of the exhaust pipe. The butterfly valve disc 2 is formed with an elliptical shape and, as can be seen in FIGS. 1, 2 and 4, is situated in a slightly oblique position when it is in its closed position. In its closed position, the butterfly valve disc 2 faces the inside of the exhaust pipe 1 with a peripheral edge surface 4. Turning the butterfly valve disc 2 from its closed position indicated in FIG. 4 by dash-dot lines to its horizontal open position and back again is effected via a crank mechanism 5 by a piston/cylinder device 6.

On top of the exhaust pipe 1, there is provided a poppet valve body 7 which extends onto the wall of the exhaust pipe and covers the latter on the outside. The poppet valve body 7 is formed with a valve bore 8 which is of circular cross section and whose diameter is reduced at the end facing the inside of the exhaust pipe 1 in the manner of a step which forms an inner-end stop 9. The valve bore 8 houses a poppet valve head 10 whose diameter increases in the manner of a step in the direction from the inside of the exhaust pipe towards the outside and which, in its closed position, contacts the stop 9 of the poppet valve body. The poppet valve head 10 is formed at its end facing the inside of the exhaust pipe with a spherically-shaped concave end face 11 and, as seen in the direction of the axis of the exhaust pipe 1 when closed extends beyond the edge surface 4 of the butterfly valve disc 2 over a considerable length in either direction.

The poppet valve head 10 is provided at its back with an elongate stem 12 which extends into a bonnet 13. This bonnet is attached to the valve body 7 and secured to it by means of a circlip. A front-end flange strip of the bonnet forms a rear stop 14 for the poppet valve head 10 which delimits the travel of the poppet valve head at the back. At the rear end of the stem 12 is provided a thrust disc 15 which is slidable guided in the cylindrical bonnet 13. Opening into the exhaust pipe 1 on the discharge side of the closed butterfly valve disc 2 is a balance passage 16 of relatively large cross-sectional area which joins the poppet valve bore 8 in a manner that with the poppet valve head 10 in the extended closed position (FIG. 1) it is only partly closed by the latter, i.e. the passage 16 is partly open, and that, according to FIG. 2, it is also at least partly open with the poppet valve head fully retracted when open, i.e. it will be only partly closed by the poppet valve head.

Bearing on the back of the thrust disc 15 is a coiled wire spring 17 which is supported at its outer end at the end of the bonnet. The support is effected via an adjusting device 18 which, however, is not mandatory. The characteristic of the spring 17 is shown as linear in FIG. 5. According to FIG. 6, the poppet valve head in its extended position is set back with its end face 11 relative to the inner cylindrical surface of the exhaust pipe 1 by a narrow gap 19 and this gap 19 also exists between the poppet valve head and the edge surface 4 of the butterfly valve disc 2 both are in the closed position as shown in FIG. 1. The gap is preferably about 0.25 to 0.5 mm in width.

With the poppet valve head 10 in its extended closed position according to FIG. 1, the spring 17 is already loaded; in the retracted position of the poppet valve head 10 shown in FIG. 2, the loading of the spring 17 is increased.

Figures 3, 5, 6:
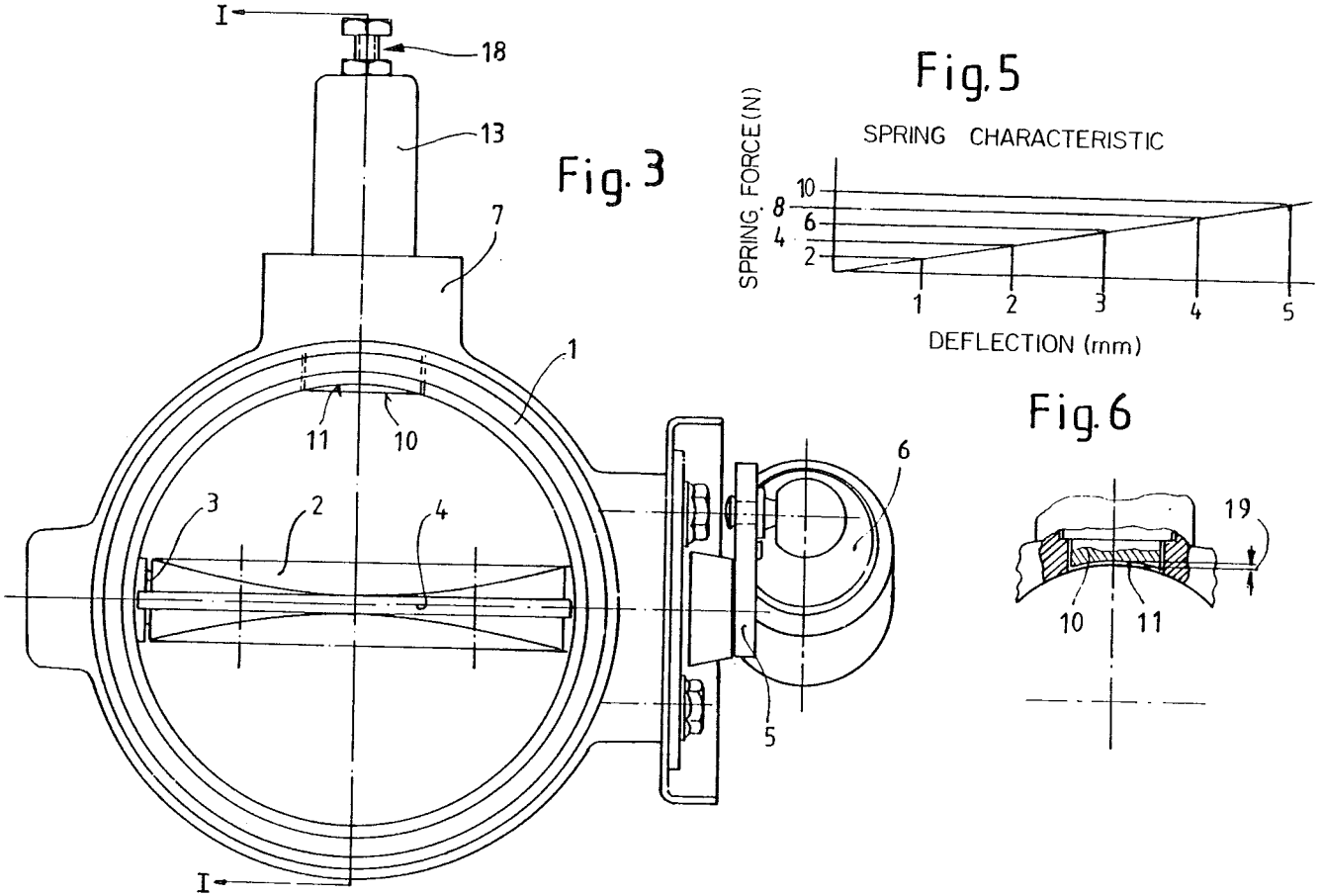
FIG. 3 is a front elevational view of the device according to FIG. 1.
FIG. 5 is a graph showing the spring characteristic of the spring of the device according to FIG. 1.
FIG. 6 is a cross-sectional view taken along line VI—VI of FIG. 4 showing the gap delimited by the poppet valve head.

As can be seen from FIGS. 3 and 4, the butterfly valve disc 2 can be turned from its horizontal open position which is parallel to the centerline of the exhaust pipe 1, to the closed position in which it is positioned transverse to the centerline.

I claim:

1. A device for limiting the dynamic pressure in an engine exhaust brake wherein a valve is provided in an exhaust pipe, the exhaust pipe having an internal circular cross-section, comprising:

a butterfly disc valve having a substantially elliptically shaped peripheral edge in the exhaust pipe;

means for pivotally mounting said butterfly disc valve in the exhaust pipe for pivotal movement about a pivotal axis between an open position wherein said disc valve allows fluid flow through said exhaust pipe past said disc valve and a closed position wherein said disc valve is substantially oblique relative to the diameter of the exhaust pipe and said peripheral edge substantially engages the inner surface of the exhaust pipe to substantially restrict fluid flow therethrough; and a pressure relief poppet valve on said exhaust pipe comprising a poppet valve housing, a poppet valve bore in said housing having an inner end communicating with the interior of the exhaust pipe at a position extending over a portion of said peripheral edge of said disc valve when said disc valve is in the closed position to provide a by-pass for fluid flow at said inner end, said bore having an axis extending in a direction offset with respect to said pivotal axis of said disc valve, a poppet valve head slidably mounted in said bore for movement between an open position remote from said inner end of said bore and a closed position adjacent the inner surface of said exhaust pipe, an inner end face on said poppet valve head having a configuration substantially conforming to the curvature of the inner surface of the exhaust pipe, said configuration and position of said inner end face relative to said inner end of said bore when said poppet valve head is in said closed position providing a narrow gap between said inner end face and said portion of said peripheral edge of said valve disc adjacent said inner end of said bore when said poppet valve head and said valve disc are both in the respective closed positions thereof to allow by-pass flow of fluid therethrough for limiting dynamic pressure in the exhaust pipe, and spring means between said poppet valve head and said housing resiliently urging said poppet valve head toward said closed position, said spring means having a linear spring characteristic comprising a ratio of spring force N to spring deflection in mm in the range of 1.5–2.5 to 1.

2. A device as claimed in claim 1 wherein:

said inner end face configuration of said poppet valve head comprises a segment of a substantially spherical concave surface.

3. A device as claimed in claim 1 wherein:

said poppet valve bore has a stepped configuration comprising two sections of different diameters and a shoulder between said two sections; and said poppet valve head has a stepped configuration on the outer surface thereof comprising two sections of different outer diameters conforming respectively to said different diameters of said bore, and a shoulder on said outer surface between said different outer diameters;

said shoulders being engaged for limiting travel of said poppet valve head and providing said narrow gap when said poppet valve head is in the closed position.

4. A device as claimed in claim 2 wherein:

said poppet valve bore has a stepped configuration comprising two sections of different diameters and a shoulder between said two sections; and said poppet valve head has a stepped configuration on the outer surface thereof comprising two sections of different outer diameters conforming respectively to said different diameters of said bore, and a shoulder on said outer surface between said different outer diameters;

said shoulders being engaged for limiting travel of said poppet valve head and providing said narrow gap when said poppet valve head is in the closed position.

5. A device as claimed in claim 1 wherein:

said spring means comprises a compression coil spring.

6. A device as claimed in claim 4 wherein:

said spring means comprises a compression coil spring.

7. A device as claimed in claim 1 wherein:

said means for pivotally mounting said butterfly disc valve comprises a shaft rotatably mounted in the exhaust pipe and having a central longitudinal axis coinciding with a diameter of the interior of the exhaust pipe.

8. A device as claimed in claim 6 wherein:

said means for pivotally mounting said butterfly disc valve comprises a shaft rotatably mounted in the exhaust pipe and having a central longitudinal axis coinciding with a diameter of the interior of the exhaust pipe.

9. A device as claimed in claim 7 wherein:

said axis of said bore extends substantially diametrically relative to the interior of the exhaust pipe and substantially perpendicularly to the plane containing said central axis of said shaft.

10. A device as claimed in claim 8 wherein:

said axis of said bore extends substantially diametrically relative to the interior of the exhaust pipe and substantially perpendicularly to the plane containing said central axis of said shaft.

* * * * *